United States Patent [19]

Grose

[11] 4,304,104

[45] Dec. 8, 1981

[54] PITOT HEAT PUMP

[75] Inventor: Ronald D. Grose, Omaha, Nebr.

[73] Assignee: Northern Natural Gas Company, Omaha, Nebr.

[21] Appl. No.: 146,136

[22] Filed: May 2, 1980

[51] Int. Cl.[3] ..... F25B 13/00

[52] U.S. Cl. ..... 62/324.2; 62/500; 415/88; 415/89

[58] Field of Search ..... 62/500, 116, 324 B; 415/88, 89

[56] References Cited

U.S. PATENT DOCUMENTS

| | | | |
|---|---|---|---|
| 2,488,157 | 11/1949 | Bassano | 62/500 |
| 3,608,331 | 9/1971 | Leonard, Jr. | 415/89 |
| 3,671,136 | 6/1972 | O'Mara et al. | 415/88 |
| 3,734,636 | 5/1973 | Leonard, Jr. | 415/88 |

OTHER PUBLICATIONS

Erickson, J. W. et al., "A New Pump For Industry–The Roto Jet," ASME Publication (1974).

*Primary Examiner*—Ronald C. Capossela
*Attorney, Agent, or Firm*—Zarley, McKee, Thomte, Voorhees & Sease

[57] ABSTRACT

A pitot heat pump is described wherein a multi-stage pitot pump is employed as the compression means in a heat pump thermodynamic cycle. The heat pump is comprised of a multi-stage vapor pitot pump, liquid pitot pump, turbine, vaporizer, evaporator, condenser and expansion valve. The turbine is used to rotate a shaft to which the impellers of the pitot pump are attached. Refrigerant gas from the evaporator enters the first stage of the pitot pump and the impeller therein forces the refrigerant gas outwardly where it enters the narrow end of a pitot tube provided therein. The discharge end of the pitot tube is in communication with the next stage of the pitot pump. In passing through the pitot tube, the refrigerant gas expands and the centrifugal force and the kinetic energy of the gas provide the energy whereby the refrigerant gas is compressed. After the last stage, the compressed gas is transmitted to the condenser of the heat pump.

5 Claims, 4 Drawing Figures

PITOT HEAT PUMP

BACKGROUND OF THE INVENTION

This invention relates to a pitot pump and more particularly to a pitot pump which is ideally suited as the compression means in a heat pump thermodynamic cycle.

In most heat pumps, the compression means is of the reciprocating type. The use of a pitot as a pump in a heat pump environment offers several advantages when applied to the heat pump, the primary advantage being that of simplicity. A heat pump employing a single moving part which rotates at a high speed enjoys simplicity and low cost provided the rotating part is inexpensive of manufacture. The advantages of a gas-fired pitot pump suitable for home application are simplicity, compactness and cost. A gas-fired heat pump of the type described also permits the realization of performance many times better than currently realizable with conventional gas-fired equipment.

In the pitot pump of this invention, the fluid is imparted an angular momentum by a rotating element similar to an impeller and the resultant kinetic energy is transformed to pressure energy as the fluid passes through a diffuser-pick-off tube or pitot tube. The pressure developed in the pitot tube is ascertainable by conventional centrigual compression equations.

Therefore, it is a principal object of the invention to provide a pitot pump.

A still further object of the invention is to provide a pitot pump for use as the compression means in the thermodynamic cycle of a heat pump.

A still further object of the invention is to provide a pitot heat pump.

A still further object of the invention is to provide a pitot heat pump which is compact, simple and inexpensive.

A further object of the invention is to provide a pitot heat pump which is extremely efficient.

A still further object of the invention is to provide a pitot pump employing a plurality of stages which cooperate with each other to compress the refrigerant gas as it passes therethrough.

These and other objects will be apparent to those skilled in the art.

SUMMARY OF THE INVENTION

Figure 1:
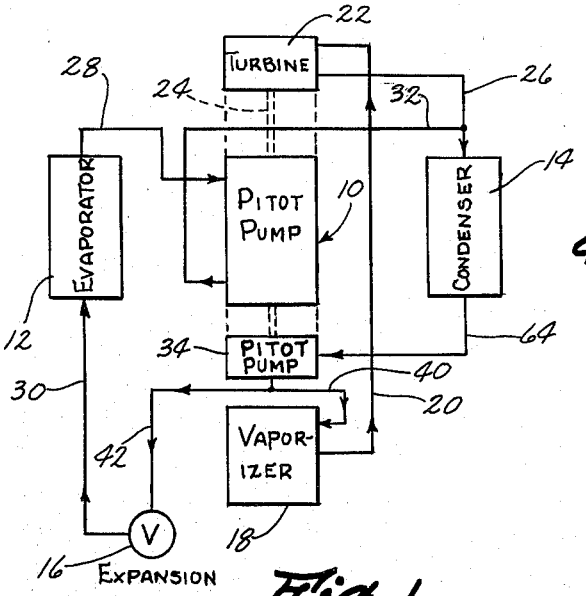
FIG. 1 is a schematic view of the heat pump of this invention.
Figure 3:
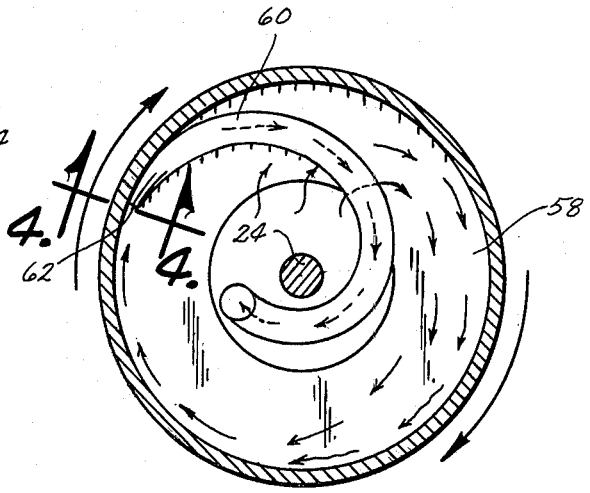
FIG. 3 is an enlarged sectional view seen on lines 3—3 of FIG. 2.

In the particular embodiment disclosed herein, a five-stage pitot pump is employed as the compression means in a heat pump thermodynamic cycle. The heat pump is comprised of the five-stage pitot pump, liquid pitot pump, turbine, vaporizer, evaporator, condenser and expansion valve. Preferably, the turbine is gas-fired and rotates a shaft to which the impellers of the five-stage pitot pump are attached. Refrigerant gas from the evaporator enters the first stage of the pitot pump and the impeller therein forces the refrigerant gas outwardly to force the refrigerant gas through the narrow end of a pitot tube provided therein. The discharge end of the pitot tube in each of the stages is in communication with the next stage of the pitot pump. The refrigerant gas expands as it passes through the pitot tube and the centrifugal force and the kinetic energy of the refrigerant gas provide the energy whereby the refrigerant gas is compressed. After the last stage, the compressed gas is transmitted to the condenser of the heat pump.

DESCRIPTION OF THE PREFERRED EMBODIMENT

The pitot pump of this invention is referred to generally by the reference numeral 10 and is ideally suited for use with conventional heat pump components including evaporator 12, condenser 14 and expansion valve 16. The evaporator, condenser and expansion valve are conventional in design and would include the necessary controls common to heat pumps generally available. The pitot pump 10 provides the compression means in the heat pump thermodynamic cycle, whether the heat pump is being used to heat or cool. The conventional reversal means for either heating or cooling operations is not depicted in the drawings.

The numeral 18 refers to a gas-fired vaporizer having an outlet line or conduit 20 extending therefrom to turbine 22 including a rotatable shaft 24 extending downwardly through the pitot pump 10. The vaporizer 18 supplies the driving medium to the turbine to cause shaft 24 to be rotated. The discharge of the turbine 22 is connected to condenser 14 by conduit 26. As seen in FIG. 1, the discharge or outlet side of the evaporator 12 is connected to pitot pump 10 by conduit 28. The outlet of expansion valve 16 is connected to the inlet of evaporator 12 by conduit 30. The discharge or outlet of the pitot pump 10 is connected to the inlet of condenser 14 by conduit 32. The numeral 34 refers to a single stage liquid pitot pump which is driven by the shaft 24 so that the fluid in compartment 36 is drawn upwardly thereinto and is pumped through the conduit 38 which is in communication with conduit 40 which extends to vaporizer 18 and to conduit 42 which extends to the inlet of expansion valve 16.

The heat pump 10 described in the drawings is shown to have five identical stages located in compartments 44, 46, 48, 50 and 52. The interior of turbine 22 is sealed from compartment 44 by means of a gas-film bearing 54. Likewise, the various compartments of the pitot pump are also hermetically sealed from each other by means of gas-film bearings 56 and/or labryhth seals.

Figure 2:
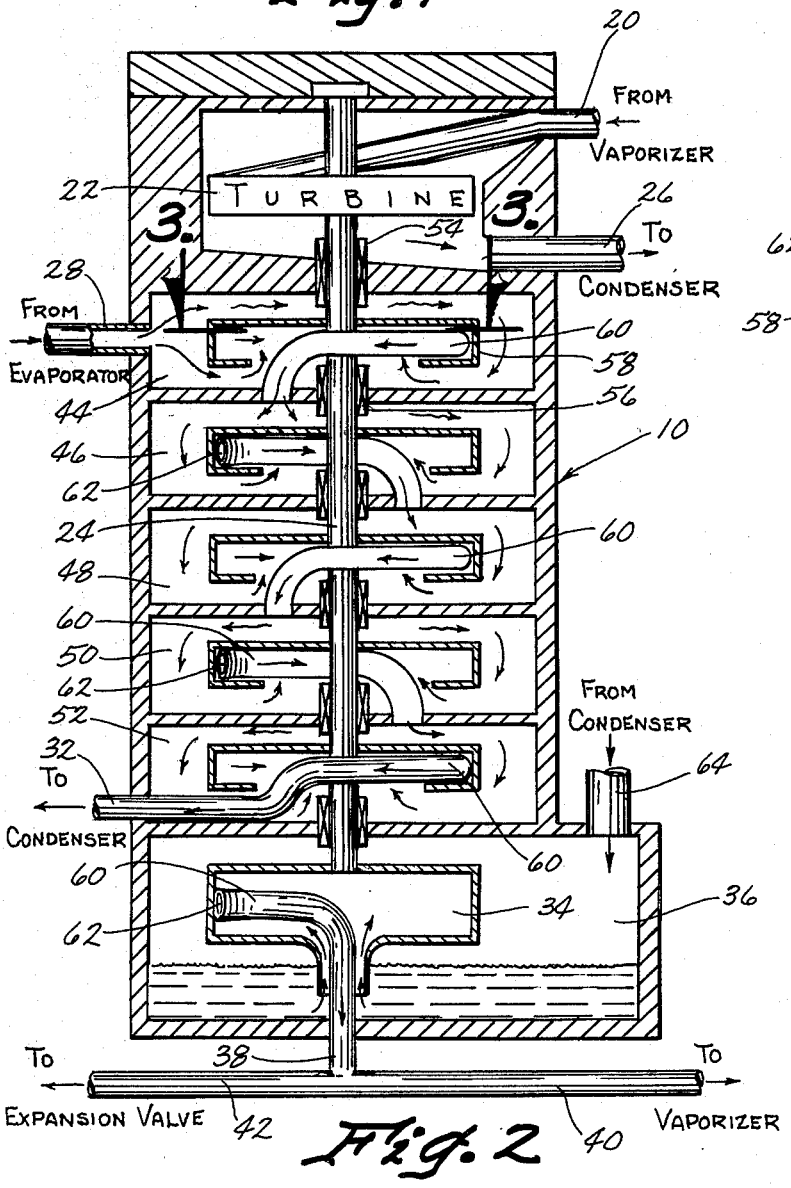
FIG. 2 is a longitudinal sectional view of the pitot pump portion of the heat pump.
Figure 4:
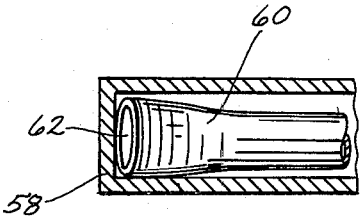
FIG. 4 is an enlarged sectional view seen on lines 4—4 of FIG. 3.

Located within each compartment is a cup-like impeller 58 which is secured to the shaft 24 for rotation therewith. At least one pitot tube 60 is positioned within each of the compartments and has its inlet end 62 closely positioned to the interior wall surface of the impeller 58 as best illustrated in FIG. 4. If desired, several pitot tubes 60 may be positioned within each of the stages. The outlet or discharge end of the pitot tube 60 in compartment 44 is in communication with compartment 46 as best illustrated in FIG. 2. As seen in FIG. 2, the outlets of each of the pitot tubes are in communication with the next stage with the discharge or outlet end of the pitot tube in compartment 52 being in operative fluid communication with the conduit 32.

In operation, the gas-fired vaporizer 18 supplies the working medium to the turbine 22 to cause the rotation of shaft 24 preferably on the order of 50,000 rpm. Refrigerant gas such as R-21 is supplied from the evaporator to compartment 44 by means of the conduit 28. The gas entering compartment 44 is imparted angular momentum by the rotating impeller 58 and the kinetic energy thereof is transformed to pressure energy in the pitot tube 60. As stated, the impeller 58 forces the refrigerant gas outwardly to the interior wall surface of the impeller where it enters the narrow end of the pitot tube and is subsequently conveyed to the next stage therebelow. The refrigerant gas is additionally compressed as it passes through the pitot tube 60. Thus the refrigerant gas is successively compressed in the compartments 44, 46, 48, 50 and 52 from approximately 5 to 100 pounds per square inch.

After the gas has been compressed in the five stages of the pitot pump, the gas is supplied to the condenser 14 by means of the conduit 32. As previously stated, the pitot pump or liquid pump 34 is also operated by the shaft 24. Freon or refrigerant gas from the condenser 14 flows there into by means of the conduit 64 and is sucked upwardly into the impeller and into the pitot tube therein by the rotating impeller. The Freon is pressurized from approximately 100 psi to 1,000 psi and flows to the expansion valve 16 and thence to the evaporator. Part of the fluid from the pump 34 is also supplied to the vaporizer 18.

Thus it can be seen that a novel pitot pump has been described for use in a heat pump which is compact, simple, inexpensive and efficient. It can be seen that the invention accomplishes at least all of the stated objectives.

I claim:

1. A heat pump comprising, a pitot pump, liquid pump, turbine, vaporizer, evaporator, condenser and expansion valve having inlets and outlets, the outlet of said liquid pump being fluidly connected to the inlet of said expansion valve, the outlet of said expansion valve being fluidly connected to the inlet of said evaporator, the outlet of said evaporator being fluidly connected to the inlet of said pitot pump, the outlet of said pitot pump being fluidly connected to the inlet of said condenser, the outlet of said condenser being fluidly connected to the inlet of said liquid pump, the outlet of said liquid pump being fluidly connected to the inlets of said vaporizer and expansion valve, the outlet of said vaporizer being fluidly connected to the inlet of said turbine, the outlet of said turbine being fluidly connected to the inlet of said condenser, means mechanically connecting said turbine to said pitot pump and liquid pitot pump whereby said pumps will be operated thereby, means for heating the gas in said vaporizer whereby gas under pressure is supplied to said turbine to operate the same.

2. The heat pump of claim 1 wherein said liquid pump comprises a second pitot pump.

3. The heat pump of claim 1 wherein said pitot pump comprises a vertically disposed housing having upper and lower ends, said housing having a plurality of spaced apart compartments therein defining at least an uppermost compartment, a lowermost compartment and an intermediate compartment therebetween, said uppermost compartment being in fluid communication with the outlet of said evaporator, said turbine including a vertically disposed rotatable shaft extending through said compartments, a cup-like impeller means in each of said compartments mounted on said shaft for rotation therewith, a pitot tube in each of said compartments having an inlet end positioned within said impeller means for receiving fluid supplied thereto by said impeller means, the discharge end of the pitot tube in said uppermost compartment being in communication with said intermediate compartment, the discharge end of the pitot tube in said intermediate compartment being in communication with said lowermost compartment, the discharge end of the pitot tube in said lowermost compartment being in operative communication with the inlet of said condenser.

4. The heat pump of claim 3 wherein said housing has a plurality of intermediate compartments provided therein.

5. The heat pump of claim 3 wherein said each of cup-like impeller means is inverted.

* * * * *